US008007050B2

(12) United States Patent
Hall et al.

(10) Patent No.: US 8,007,050 B2
(45) Date of Patent: Aug. 30, 2011

(54) DEGRADATION ASSEMBLY

(75) Inventors: David R. Hall, Provo, UT (US); Ronald Crockett, Payson, UT (US); Jeff Jepson, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 264 days.

(21) Appl. No.: 12/051,586

(22) Filed: Mar. 19, 2008

(65) Prior Publication Data

US 2008/0164748 A1 Jul. 10, 2008

Related U.S. Application Data

(63) Continuation-in-part of application No. 12/021,051, filed on Jan. 28, 2008, which is a continuation of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/051,586, which is a continuation-in-part of application No. 11/965,672, filed on Dec. 27, 2007, which is a continuation-in-part of application No. 11/686,831, filed on Mar. 15, 2007, now Pat. No. 7,568,770.

(51) Int. Cl.
*E21C 35/197* (2006.01)

(52) U.S. Cl. ..... 299/106; 299/104

(58) Field of Classification Search ..... 299/106, 299/107, 104, 105, 111, 113
See application file for complete search history.

(56) References Cited

U.S. PATENT DOCUMENTS 2,004,315 A 6/1935 Fean (Continued)

FOREIGN PATENT DOCUMENTS

DE 3307910 9/1984

(Continued)

OTHER PUBLICATIONS

Kennametal Inc. catalog entitled, "Construction Tools," 1997, pp. 1-20.

(Continued)

*Primary Examiner* — John Kreck
(74) *Attorney, Agent, or Firm* — Brinks Hofer Gilson & Lione

(57) ABSTRACT

A degradation assembly comprises a rotating portion and a fixed portion. The rotating portion comprises a wear resistant tip bonded to a carbide bolster. The bolster is attached to a shaft adapted for a rotatable connection within a bore of the fixed portion. The fixed portion is adapted for a rigid connection to a driving mechanism. The fixed portion includes an O-ring slot formed within its bore and with an O-ring being disposed therein. The O-ring is at least 15 percent compressed such that the O-ring resists rotation of the shaft.

30 Claims, 7 Drawing Sheets

U.S. PATENT DOCUMENTS 2,124,438 A 7/1938 Struk
3,254,392 A 6/1966 Novkov
3,342,531 A 9/1967 Krekeler
3,342,532 A 9/1967 Krekeler
3,745,396 A 7/1973 Maynard et al.
3,746,396 A 7/1973 Radd
3,767,266 A 10/1973 Krekeler
3,807,804 A 4/1974 Kniff
3,830,321 A 8/1974 McKenry
3,932,952 A 1/1976 Helton
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,149,753 A * 4/1979 Stoltz et al. ..... 299/107
4,156,329 A 5/1979 Daniels
4,199,035 A 4/1980 Thompson
4,201,421 A 5/1980 Den Besten
4,251,109 A 2/1981 Roepke
4,268,089 A 5/1981 Spence
4,277,106 A 7/1981 Sahley
4,289,211 A 9/1981 Lumen
4,439,250 A 3/1984 Acharya
4,465,221 A 8/1984 Schmidt
4,484,644 A 11/1984 Cook
4,484,783 A 11/1984 Emmerich
4,489,986 A 12/1984 Dziak
4,542,942 A 9/1985 Zitz et al.
4,660,890 A 4/1987 Mills
4,678,237 A 7/1987 Collin
4,682,987 A 7/1987 Brady
4,684,176 A 8/1987 Den Besten
4,688,856 A 8/1987 Elfgen
4,725,098 A 2/1988 Beach
4,728,153 A 3/1988 Ojanen
4,729,603 A 3/1988 Elfgen
4,736,533 A 4/1988 May
4,765,686 A 8/1988 Adams
4,765,687 A 8/1988 Parrott
4,778,682 A 10/1988 Chapman
4,798,026 A 1/1989 Cerceau
4,836,614 A 6/1989 Ojanen
4,850,649 A 7/1989 Beach et al.
4,880,154 A 11/1989 Tank
4,921,310 A 5/1990 Hedlund et al.
4,932,723 A 6/1990 Mills
4,940,288 A 7/1990 Stiffler et al.
4,944,559 A 7/1990 Sionnet
4,951,762 A 8/1990 Lundell
5,007,685 A 4/1991 Beach
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,261,499 A 11/1993 Grubb
5,303,984 A 4/1994 Ojanen
5,332,348 A 7/1994 Lemelson
5,417,475 A 5/1995 Graham
5,447,208 A 9/1995 Lund
5,503,463 A 4/1996 Ojanen
5,535,839 A 7/1996 Brady
5,542,993 A 8/1996 Rabinkin
5,653,300 A 8/1997 Lund
5,720,528 A 2/1998 Ritchey
5,725,283 A 3/1998 O'Neill
5,738,415 A 4/1998 Parrott
5,738,698 A 4/1998 Kapoor
5,823,632 A 10/1998 Burkett
5,837,071 A 11/1998 Anderson
5,842,747 A * 12/1998 Winchester ..... 299/87.1
5,845,547 A 12/1998 Sollami
5,875,862 A 3/1999 Jurewicz
5,884,979 A 3/1999 Latham
5,934,542 A 8/1999 Nakamura
5,935,718 A 8/1999 Demo
5,944,129 A 8/1999 Jenson
5,967,250 A 10/1999 Lund
5,992,405 A * 11/1999 Sollami ..... 125/36
6,006,846 A 12/1999 Tibbitts et al.
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,099,081 A 8/2000 Warren
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,357,832 B1 3/2002 Sollami
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,481,803 B2 11/2002 Ritchey
6,499,547 B2 12/2002 Scott
6,508,516 B1 1/2003 Kammerer
6,517,902 B2 2/2003 Drake
6,585,326 B2 7/2003 Sollami
6,585,327 B2 7/2003 Sollami
6,644,755 B1 11/2003 Kammerer
6,685,273 B1 2/2004 Sollami
6,692,083 B2 2/2004 Latham
6,709,065 B2 3/2004 Peay
6,719,074 B2 4/2004 Tsuda
6,733,087 B2 * 5/2004 Hall et al. ..... 299/113
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Hughes et al.
6,863,352 B2 3/2005 Sollami
6,889,890 B2 5/2005 Yamazaki et al.
6,966,611 B1 11/2005 Sollami
6,994,404 B1 2/2006 Sollami
7,118,181 B2 * 10/2006 Frear ..... 299/104
7,204,560 B2 4/2007 Mercier
7,270,379 B2 9/2007 Stehney
7,322,776 B2 1/2008 Webb
7,380,888 B2 6/2008 Ojanen
2002/0175555 A1 11/2002 Mercier
2003/0015907 A1 1/2003 Sollami
2003/0140350 A1 7/2003 Watkins et al.
2003/0209366 A1 11/2003 McAlvain
2003/0230926 A1 12/2003 Mondy et al.
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0125306 A1 6/2006 Sollami
2006/0237236 A1 10/2006 Sreshta
2006/0261663 A1 11/2006 Sollami

FOREIGN PATENT DOCUMENTS

DE 3500261 7/1986
DE 3818213 11/1989
DE 4039217 6/1992
DE 19821147 11/1999
DE 10163717 5/2003
EP 0295151 12/1988
EP 0412287 2/1991
GB 2004315 3/1979

| | | |
|---|---|---|
| GB | 2037223 | 7/1980 |
| JP | 5280273 A | 10/1993 |

OTHER PUBLICATIONS

International Search Report for PCT/US08/69231, mailed Nov. 18, 2008.

Written Opinion for PCT/US08/69231, mailed Nov. 18, 2008.

International Preliminary Report of Patentability for PCT/US08/69231, mailed Jan. 5, 2010.

* cited by examiner

DEGRADATION ASSEMBLY

RELATED APPLICATIONS

This application is a continuation-in-part of U.S. patent application Ser. No. 12/021,051, filed on Jan. 28, 2008, which is a continuation of U.S. patent application Ser. No. 12/021,019, filed on Jan. 28, 2008, which is a continuation-in-part of U.S. patent application Ser. No. 11/971,965, filed on Jan. 10, 2008, now U.S. Pat. No. 7,648,210, which is a continuation of U.S. patent application Ser. No. 11/947,644, filed on Nov. 29, 2007, which is a continuation-in-part of U.S. patent application Ser. No. 11/844,586, filed on Aug. 24, 2007, now U.S. Pat. No. 7,600,823. U.S. patent application Ser. No. 11/844,586 is a continuation-in-part of U.S. patent application Ser. No. 11/829,761, filed on Jul. 27, 2007, now U.S. Pat. No. 7,722,127. U.S. patent application Ser. No. 11/829,761 is a continuation-in-part of U.S. patent application Ser. No. 11/773,271, filed on Jul. 3, 2007. U.S. patent application Ser. No. 11/773,271 is a continuation-in-part of U.S. patent application Ser. No. 11/766,903, filed on Jun. 22, 2007. U.S. patent application Ser. No. 11/766,903 is a continuation of U.S. patent application Ser. No. 11/766,865, filed on Jun. 22, 2007. U.S. patent application Ser. No. 11/766,865 is a continuation-in-part of U.S. patent application Ser. No. 11/742,304, filed on Apr. 30, 2007, now U.S. Pat. No. 7,475,948. U.S. patent application Ser. No. 11/742,304 is a continuation of U.S. patent application Ser. No. 11/742,261, filed on Apr. 30, 2007, now U.S. Pat. No. 7,469,971. U.S. patent application Ser. No. 11/742,261 is a continuation-in-part of U.S. patent application Ser. No. 11/464,008, filed on Aug. 11, 2006, now U.S. Pat. No. 7,338,135. U.S. patent application Ser. No. 11/464,008 is a continuation-in-part of U.S. patent application Ser. No. 11/463,998, filed on Aug. 11, 2006, now U.S. Pat. No. 7,384,105. U.S. patent application Ser. No. 11/463,998 is a continuation-in-part of U.S. patent application Ser. No. 11/463,990, filed on Aug. 11, 2006, now U.S. Pat. No. 7,320,505. U.S. patent application Ser. No. 11/463,990 is a continuation-in-part of U.S. patent application Ser. No. 11/463,975, filed on Aug. 11, 2006, now U.S. Pat. No. 7,445,294. U.S. patent application Ser. No. 11/463,975 is a continuation-in-part of U.S. patent application Ser. No. 11/463,962, filed on Aug. 11, 2006, now U.S. Pat. No. 7,413,256. U.S. patent application Ser. No. 11/463,962 is a continuation-in-part of U.S. patent application Ser. No. 11/463,953, filed on Aug. 11, 2006, now U.S. Pat. No. 7,464,993. The present application is also a continuation-in-part of U.S. patent application Ser. No. 11/695,672, filed on Dec. 27, 2007. U.S. patent application Ser. No. 11/695,672 is a continuation-in-part of U.S. patent application Ser. No. 11/686,831, filed on Mar. 15, 2007, now U.S. Pat. No. 7,568,770. All of these applications are herein incorporated by reference for all that they contain.

BACKGROUND OF THE INVENTION

Efficient degradation of materials is important to a variety of industries including the asphalt, mining, and excavation industries. In the asphalt industry, pavement may be degraded using attack tools, and in the mining industry, attack tools may be used to break minerals and rocks. Attack tools may also be used when excavating large amounts of hard materials. In asphalt recycling, often, a drum supporting an array of attack tools disposed within holders, together making up a degradation assembly, may be rotated and moved so that the attack tools engage a paved surface causing the tools and/or holders to wear. Much time is wasted in the asphalt recycling industry due to high wear of the degradation assemblies, which typically have a tungsten carbide tip.

U.S. Pat. No. 6,733,087 to Hall et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a superhard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in the region of greatest variance.

Examples of degradation assemblies from the prior art are disclosed in U.S. Pat. No. 6,824,225 to Stiffler, U.S. Pat. App. Pub. No. 2005/0173966 to Mouthaan, U.S. Pat. No. 6,692,083 to Latham, U.S. Pat. No. 6,786,557 to Montgomery, Jr., U.S. Pat. App. Pub. No. 2003/0230926, U.S. Pat. No. 4,932,723 to Mills, U.S. Pat. App. Pub. No. 2002/0175555 to Merceir, U.S. Pat. No. 6,854,810 to Montgomery, Jr., U.S. Pat. No. 6,851,758 to Beach, which are all herein incorporated by reference for all they contain.

BRIEF SUMMARY OF THE INVENTION

In one aspect of the present invention, a degradation assembly comprises a rotating portion and a fixed portion. The rotating portion comprises a wear resistant tip bonded to a carbide bolster. The bolster is attached to a shaft adapted for a rotatable connection within a bore of the fixed portion. The fixed portion is adapted for a rigid connection to a driving mechanism. The fixed portion also comprises an O-ring slot formed within its bore and an O-ring being disposed within the bore, such that the O-ring contacts the shaft of the rotating portion. The O-ring is at least 15 percent compressed such that the O-ring resists rotation of the shaft.

The shaft may be a shank or a sleeve. The shank may be disposed within a sleeve. The shaft may also be tapered on the end attached to the bolster to aid in reducing stress risers. The shaft may be formed from a steel body which is rigidly connected to the bolster. The shaft may comprise a tapered face adapted to be attached to the bolster. The bolster may also comprise a cavity with a lip adapted to attach to a locking mechanism. The fixed portion may comprise a wire snap ring slot formed within its bore. The O-ring may comprise a diameter smaller than a diameter of a wire snap ring. The bolster may comprise a tapered base end. The bolster may be mechanically attached to the shaft or shank by a locking mechanism. The locking mechanism may be axially disposed within the fixed portion, the rotating portion, and the shaft. The locking mechanism may be adapted to lock to a cavity of the bolster. The locking mechanism may be threaded through the fixed portion. A bore of the shaft may comprise a geometry of the locking mechanism. This may aid in supporting the locking mechanism and help in stabilizing it.

DETAILED DESCRIPTION OF EXEMPLARY EMBODIMENTS

Figure 1:
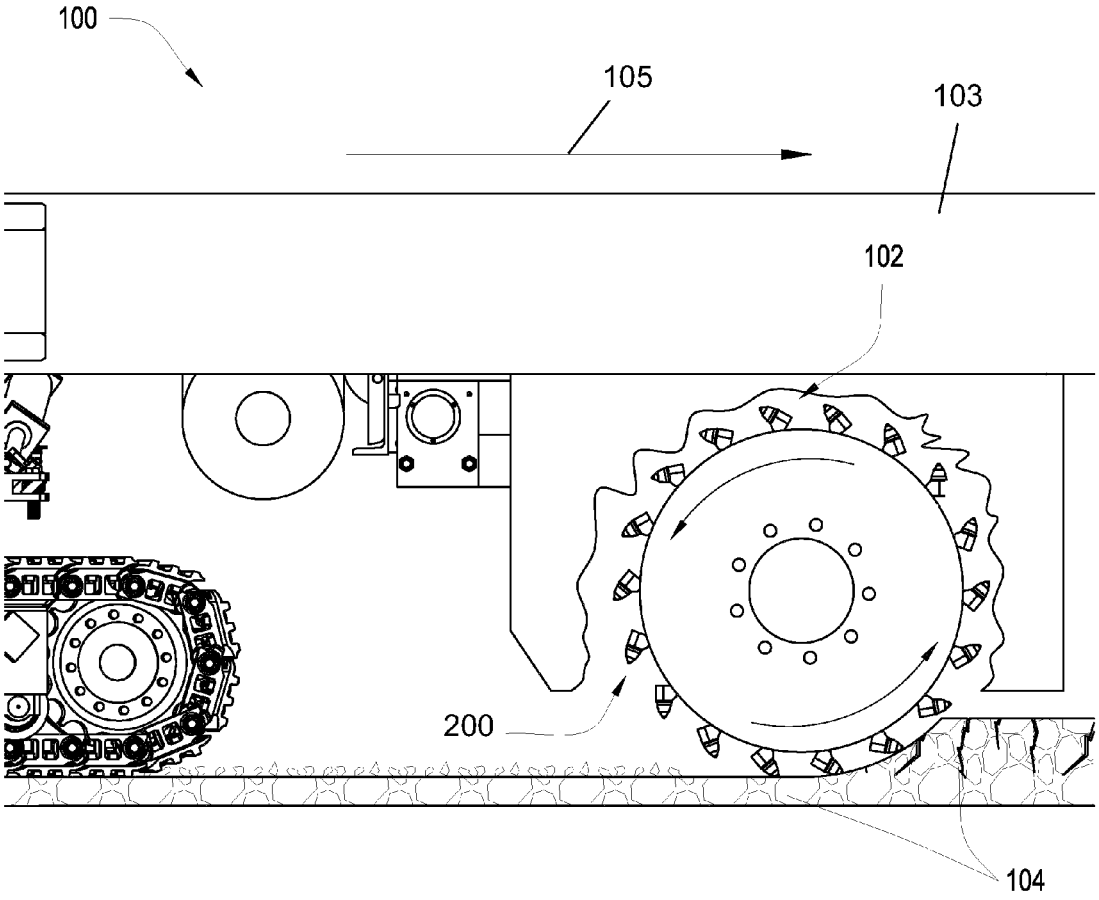
FIG. 1 is a schematic side view of a representative asphalt milling machine.

FIG. 1 is a cross sectional diagram of an embodiment of an asphalt milling machine 100. The asphalt milling machine 100 may comprise a driving mechanism 102 attached to a motor vehicle 103. A plurality of degradation assemblies 200 may be secured to the driving mechanism 102. The driving mechanism 102 may be a rotating drum, a chain, a rotor, or combinations thereof. The asphalt milling machine 100 may degrade a paved surface 104 of a road, sidewalk, or parking lot prior to applying new pavement. The driving mechanism 102 may rotate such that the degradation assemblies 200 engage the paved surface 104 as the motor vehicle 103 moves in a direction indicated by the arrow 105. In other embodiments of the invention, the driving mechanism 102 may be attached to a mining vehicle or other drilling machine.

Figure 2:
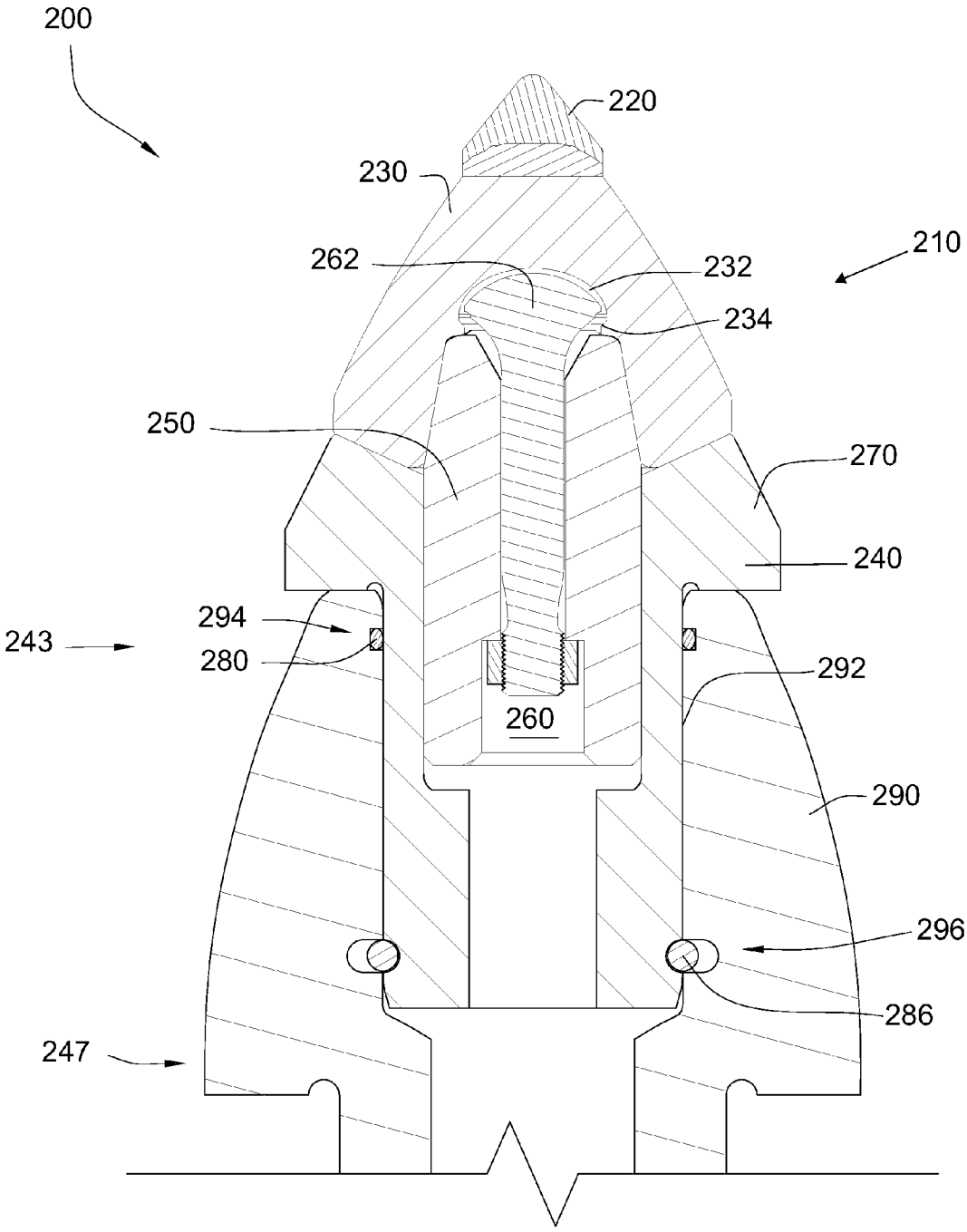
FIG. 2 is a cross-sectional diagram of an embodiment of a degradation assembly.

FIG. 2 is a cross-sectional diagram of an embodiment of the degradation assembly 200 of FIG. 1. The degradation assembly 200 may comprise a rotating portion 210 supported by a fixed portion 290 that is attached to the driving mechanism. The rotation of the rotating portion 210 may aid in degradation of material. The rotating portion 210 can include a wear resistant tip 220 bonded to a carbide bolster 230. The bolster 230 may be attached to a shaft 240, which shaft is in turn adapted for rotatable connection within a bore 292 of the fixed portion 290. The shaft 240 can include both an inner shank 250 installed within an outer sleeve 270, with the shank 250 being coupled to the bolster 230 with a coaxial locking mechanism 260 adapted to attach to a cavity 232 of the bolster 230. The cavity 232 of the bolster 230 may comprise a lip 234 adapted to attach to a head 262 of the locking mechanism 260. As shown in FIG. 2, the bolster 230 may be isolated from the fixed portion 290 by the sleeve portion 270 of the shaft 240.

The fixed portion 290 of the degradation assembly 200 may be adapted for a rigid connection to the driving mechanism. The fixed portion 290 may also comprise an O-ring slot 294 formed within its bore 292. With the shaft 240 installed in the bore 292 of the fixed portion, the O-ring 280 may be at least 15 percent compressed such that the O-ring resists rotation of the shaft 240 within the bore. It is believed that an O-ring 280 resisting rotation of the shaft 240 will aid in resisting wear of the rotating portion 210 of the degradation assembly 200. It is also believed that an O-ring 280 may prevent debris from entering the assembly 200. The O-ring 280 may be disposed proximate a first end 243 of the shaft 240.

The fixed portion 290 may also comprise a wire snap ring slot 296 formed within its bore 292. A snap ring 286 may be disposed around a second end 247 of the shaft 240 to stabilize the rotating portion 210 of the degradation assembly 200.

Figure 3:
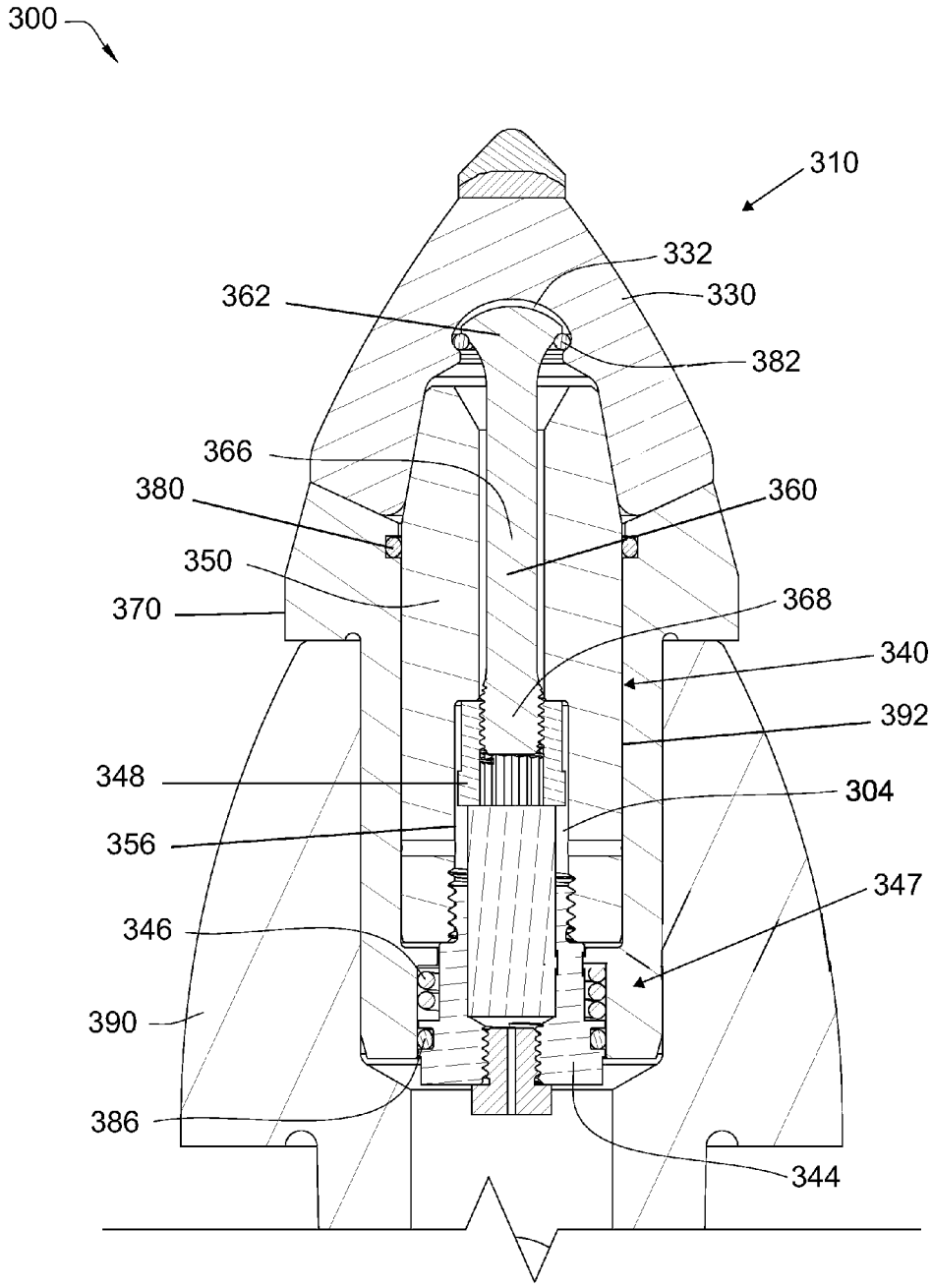
FIG. 3 is a cross-sectional diagram of another embodiment of a degradation assembly.

FIG. 3 is a cross-sectional diagram of another embodiment of the degradation assembly 300. The degradation assembly 300 may comprise a locking mechanism 360 adapted to attach the shaft 340 to the bolster 330, which shaft 340 can include a shank 350 coupled to a threaded attachment 344. The locking mechanism 360 may comprise a locking shaft 366 intermediate a locking head 362 and a threaded base end 368. The locking head 362 may comprise a complementary geometry relative to a geometry of the cavity 332 of the bolster 330. The bolster cavity 332 may include an O-ring 382 that may aid in wear resistance. The threaded base end 368 of the locking shaft 366 may be threadedly attached to a locking nut 348 located within a shank cavity 356 formed into the base of the shank 350.

The base end 347 of the shaft 340 can include a threaded attachment 344 that is threaded into the base portion of the shank cavity 356 and about a spring 346, which spring 346 may add to the life of the degradation assembly by minimizing axial wobble in the rotating portion. The base end 347 of the shaft 340 may also comprise a snap ring 386 disposed around the threaded attachment 344 and adapted to connect the shaft 340 of the rotating portion 201 to the non-rotating sleeve 370 of the fixed portion 390 of the degradation assembly 300.

The degradation assembly 300 may also comprise a fluid passage 304 formed within the shaft 340 and/or shank 350 of the rotating portion 310. The fluid passage 304 may run through the shaft 340 and/or shank 350 and into surrounding portions of the degradation assembly 300. Thus, a fluid may be passed through a port in the threaded attachment 344, into the fluid passage 304 formed into the shaft 340 and/or shank 350, and into the degradation assembly 300, for added wear resistance and lubrication.

Figure 4:
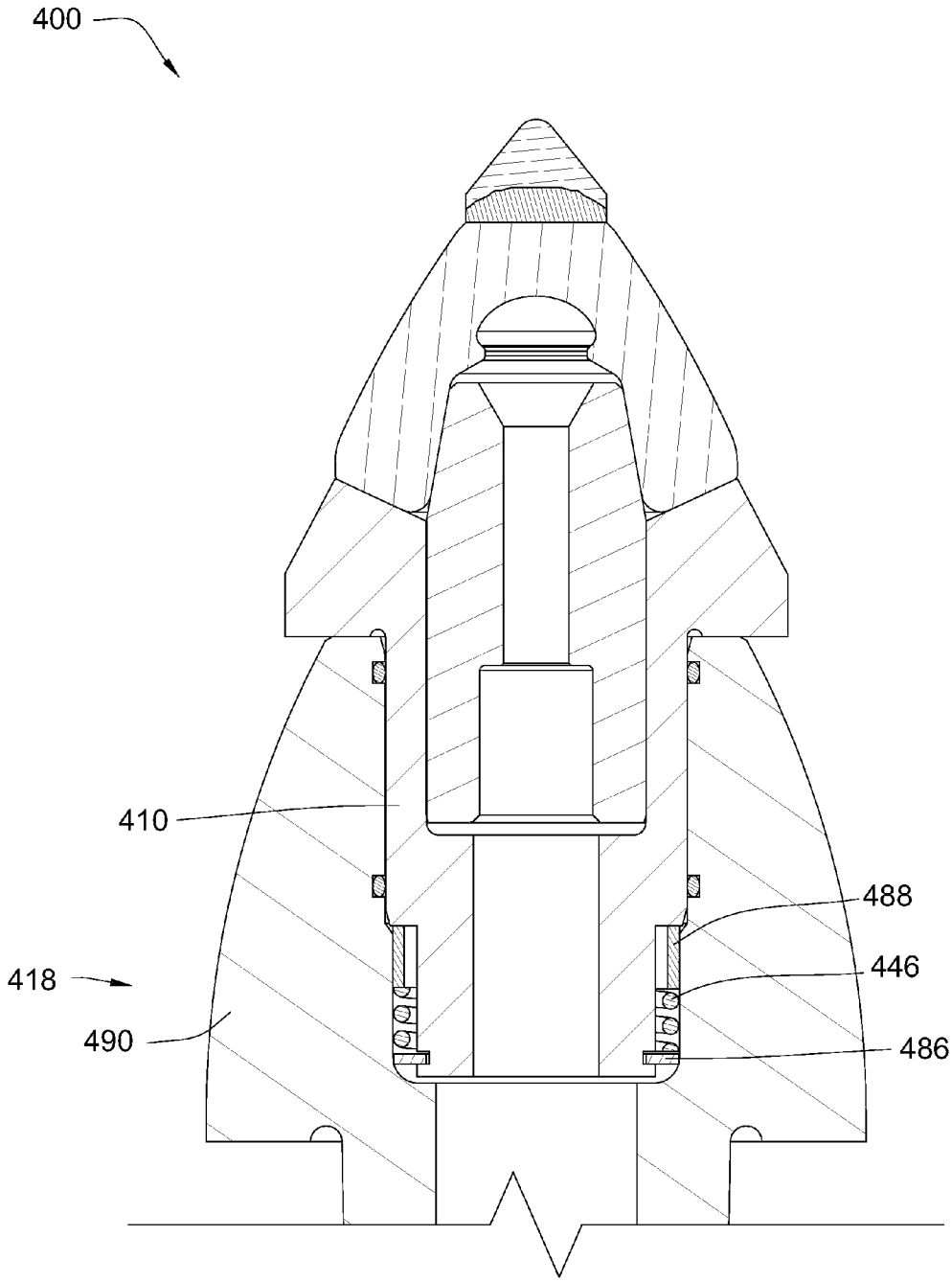
FIG. 4 is a cross-sectional diagram of another embodiment of a degradation assembly.

FIG. 4 is a cross-sectional diagram of another embodiment of a degradation assembly 400. The fixed portion 490 of the degradation assembly 400 may comprise a snap ring 486 disposed at the second end 418 of the rotating portion 410, and which snap ring is adapted to secure the rotating portion 410 to the fixed portion 490. The rotating portion 410 may rotate around the snap ring 486. A plurality of springs 446 may be disposed around the second end 418 of the rotating portion 410 as well. It is believed that the spring 446 may add to the life of the degradation assembly 400 by minimizing axial movement in the degradation assembly. A second spring 488 may be a retaining spring. The second spring 488 may stabilize the rotating portion 410.

Figure 5:
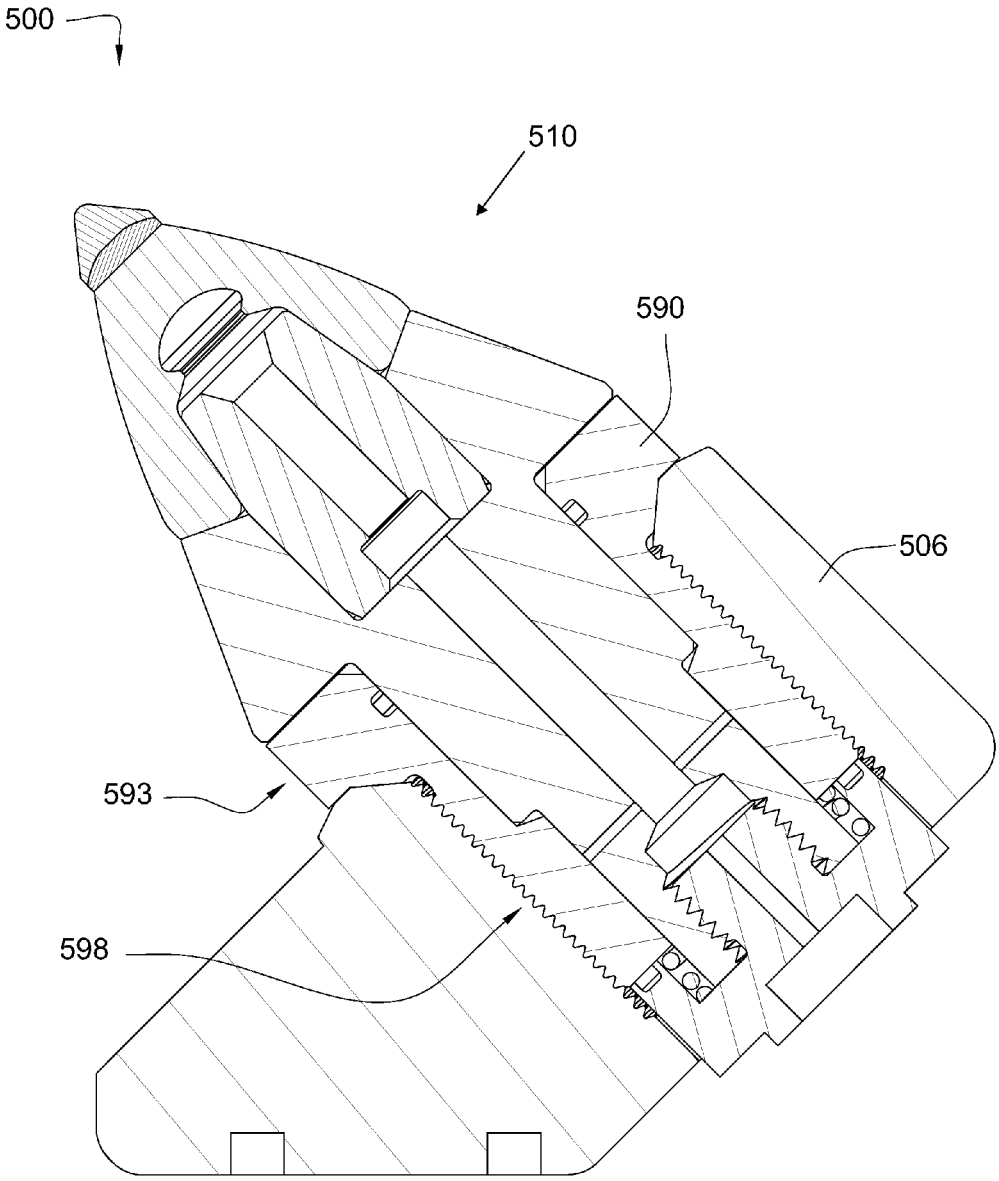
FIG. 5 is a cross-sectional diagram of another embodiment of a degradation assembly.

FIG. 5 is a cross-sectional diagram of another embodiment of a degradation assembly 500. The fixed portion 590 of the degradation assembly 500 may comprise a threadform 598 adapted to be threadedly attached to a holder 506. A first end 593 of the fixed portion 590 may comprise a hexagonal geometry. The fixed portion 590 may comprise a diameter less than a diameter of the rotating portion 510.

Figure 6:
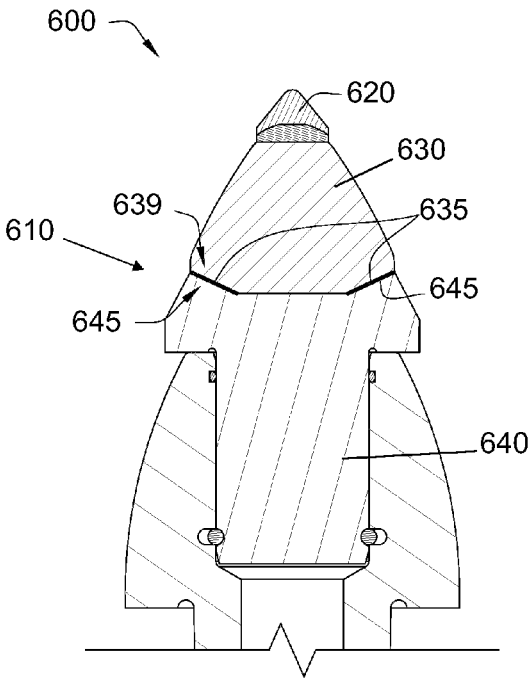
FIG. 6 is a cross-sectional diagram of another embodiment of a degradation assembly.

FIG. 6 is a cross-sectional diagram of another embodiment of a degradation assembly 600. The degradation assembly 600 may comprise a rotating portion 610 that includes a carbide bolster 630 intermediate a tip 220 and a shaft 640. The shaft 640 may comprise a taper 645 adapted to receive a taper 635 of the carbide bolster 630. The tapers may aid in wear resistance to the assembly during degradation of a material. The tapers 635, 645 may be able to withstand greater forces at more angles than if there were no taper. The bolster 630 may be brazed 639 along its taper to the shaft 640. In some embodiments, the bolster is only brazed along the taper.

Figure 7:
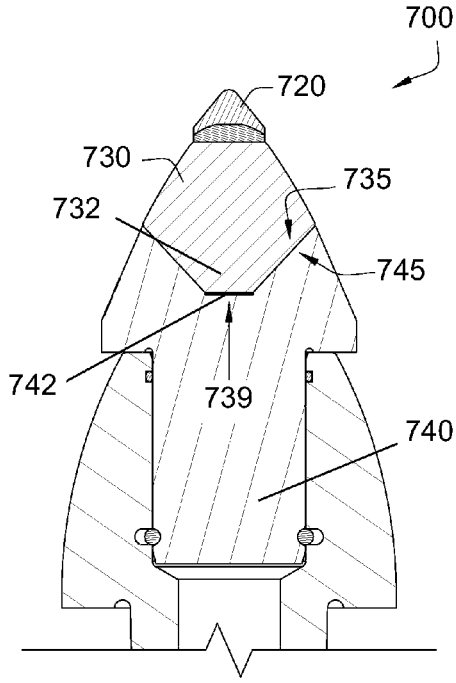
FIG. 7 is a cross-sectional diagram of another embodiment of a degradation assembly.

FIG. 7 is a cross-sectional diagram of another embodiment of a degradation assembly 700. The degradation assembly 700 may comprise a rotating portion 710 that includes a carbide bolster 730 intermediate a tip 720 and a shaft 740. The shaft 740 may comprise a taper 745 adapted to receive a taper 735 of the carbide bolster 730. The bolster 730 may be brazed 739 along a base portion 732 to a face 742 of the rotating portion. This may provide the advantage of minimizing the surface areas that are brazed since the applicants have found that a larger surface area may compromise the integrity of the braze.

Figure 8:
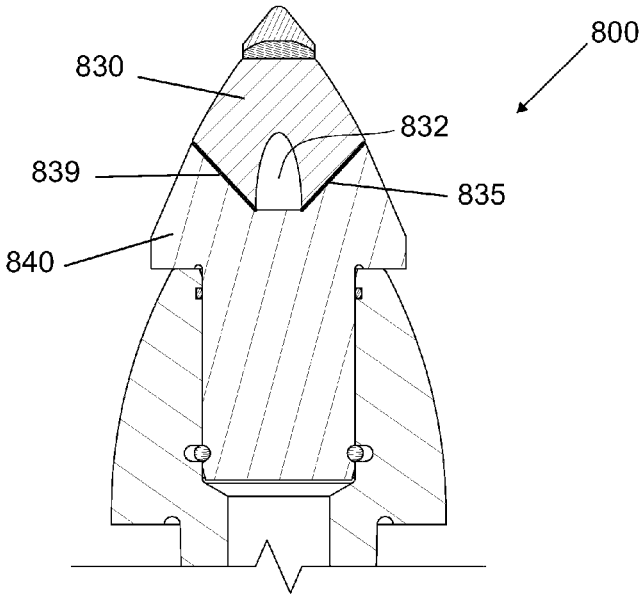
FIG. 8 is a cross-sectional diagram of another embodiment of a degradation assembly.

FIG. 8 shows another embodiment of the degradation assembly 800 in which the bolster 830 may be brazed 839 to the steel body of a shaft 840 along a taper 835 of the base of the bolster. A cavity 832 in the bolster 830 reduces the surface area of the braze. In some embodiments, voids may be formed along the taper 835 to reduce surface area of the braze.

Figure 9:
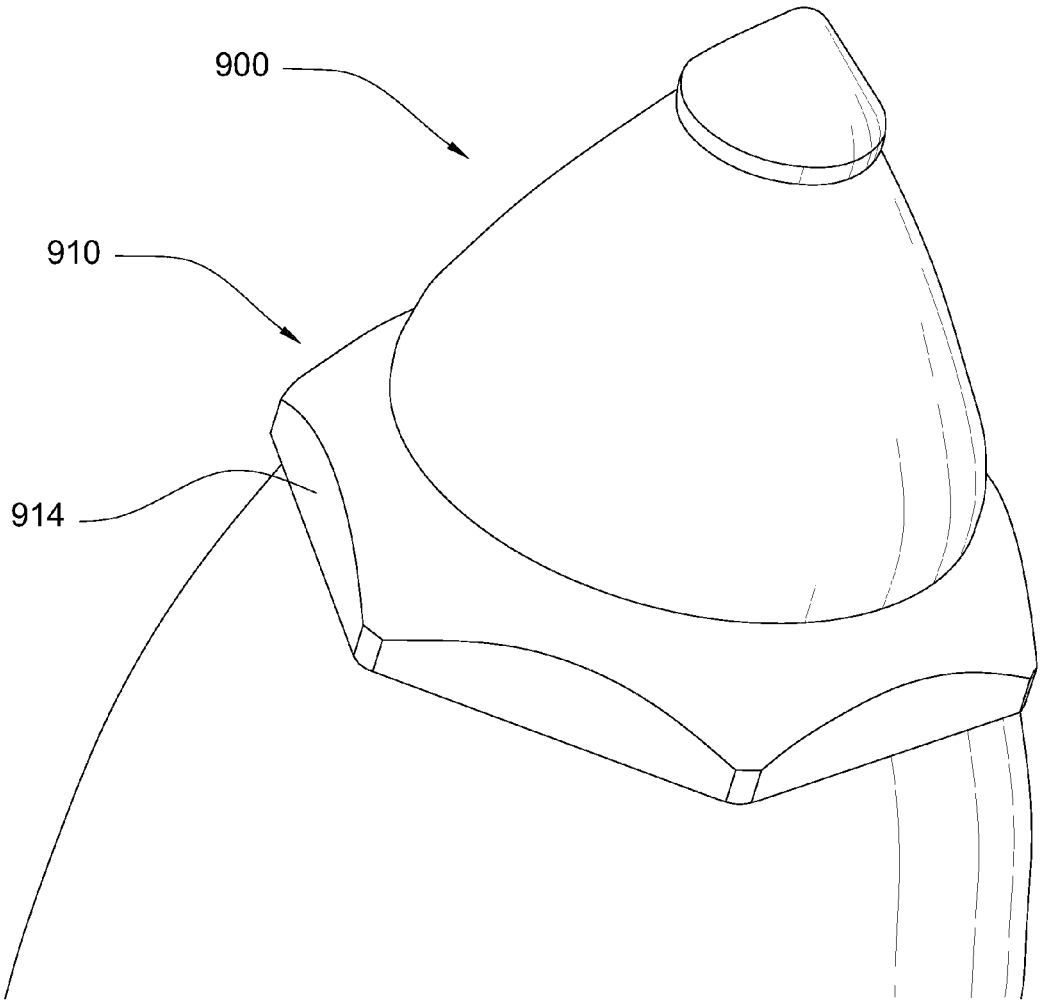
FIG. 9 is a perspective diagram of another embodiment of a degradation assembly.

FIG. 9 discloses another embodiment of the degradation assembly 900 with flats 914 incorporated on the rotating portion 910. These flats may be use to apply torque to the rotating portion with a tool such as a wrench. In some embodiments, the degradation assembly is used for a period of time and then manually rotated so that wear occurs more evenly.

Whereas the present invention has been described in particular relation to the drawings attached hereto, it should be understood that other and further modifications apart from those shown or suggested herein, may be made within the scope and spirit of the present invention.

What is claimed is:

1. A degradation assembly comprising:

a rotating portion including:

a carbide bolster having a base end and a working end;

a wear resistant tip bonded to the working end; and a shaft having a first end and a second end spaced away from the first end, the first end being attached to the base end;

a fixed portion adapted for rigid connection to a driving mechanism, the fixed portion having a bore formed therein, the bore being sized and shaped to receive the shaft of the rotating portion, the bore having an O-ring slot formed therein; and an O-ring located within the O-ring slot and contacting the shaft, the O-ring being at least 15 percent compressed by the shaft such that the O-ring substantially resists rotation of the shaft relative to the bore.

2. The degradation assembly of claim 1, wherein the shaft comprises:

a shank, the shank being attached to the base end, and a sleeve, wherein the shank is a disposed within the sleeve.

3. The assembly of claim 1, further comprising a tapered receptacle formed in the first end of the shaft, the tapered receptacle being adapted to receive therein a tapered base end of the carbide bolster.

4. The degradation assembly of claim 3, wherein the base end of the bolster comprises a taper complementary with the tapered receptacle.

5. The degradation assembly of claim 1, wherein the shaft is between the bolster and the fixed portion.

6. The degradation assembly of claim 1, further comprising a locking mechanism, the locking mechanism being adapted to attach the shaft to the base end of the carbide bolster.

7. The degradation assembly of claim 6, wherein the locking mechanism is axially disposed within both the bore of the fixed portion and the shaft of the rotating portion.

8. The degradation assembly of claim 6, further comprising a cavity formed in the based end of the bolster, and wherein the locking mechanism is adapted to interlock with the cavity.

9. The degradation assembly of claim 8, wherein the locking mechanism comprises a threadform proximate the second end of the shaft, the threadform being engagable with a threaded locking device.

10. The degradation assembly of claim 8, wherein the locking mechanism comprises a protruding member proximate the first end of the shaft, the protruding member being mechanically engagable with an internal lip of the cavity.

11. The degradation assembly of claim 1, wherein the wear resistant tip comprises:

a carbide substrate; and a diamond layer, the diamond layer being bonded to the carbide substrate, and the carbide substrate having an axial thickness that is less than an axial thickness of the diamond layer as measured along a centerline axis of the rotating portion.

12. A degradation assembly for use with a driving mechanism, said degradation assembly comprising:

a first portion including:

a carbide bolster having a base end and a working end, a wear resistant tip bonded to said working end, and a shaft having a first end and a second end spaced apart from said first end, said first end being attached to said base end, said second end having an outside surface;

a second portion connectable to a driving mechanism, said second portion having a bore formed therein, and said bore being sized and shaped to receive said shaft of said first portion, said bore having an inside surface;

an O-ring groove, said O-ring groove being formed within one of said outside surface of said shaft and said inside surface of said bore; and an O-ring, said O-ring being located within said O-ring groove, said O-ring being adapted to contact the other of said outside surface of said shaft and said inside surface of said bore, and said O-ring being adapted to impede rotation of said shaft and said bore relative to each other.

13. The degradation assembly of claim 12, wherein said O-ring is at least 15 percent compressed between said outside surface of said shaft and said inside surface of said bore.

14. The degradation assembly of claim 12, further comprising:

said second portion being adapted for rigid connection to said driving mechanism;

said O-ring groove being formed into said inside surface of said bore; and said O-ring being positionable within said O-ring groove and adapted to contact said outside surface of said rotating shaft.

15. The degradation assembly of claim 12, further comprising a tapered receptacle formed in said first end of said shaft, said tapered receptacle being adapted to receive therein a tapered base end of said carbide bolster.

16. The degradation assembly of claim 12, wherein said shaft further comprises:

a shank, said shank being attached to said base end; and a sleeve, said sleeve being disposed about said shank.

17. The degradation assembly of claim 16, further comprising a locking mechanism, said locking mechanism being configured to attach said shank to said base end.

18. The degradation assembly of claim 17, wherein said locking mechanism is axially disposed within each of said shank and said bore.

19. The degradation assembly of claim 16, wherein said resistance device is adapted to contact an outside surface of said sleeve.

20. The degradation assembly of claim 12, wherein said second portion comprises:

a fixed portion, said fixed portion connectable to said driving mechanism; and a sleeve, said sleeve installed within said fixed portion, said sleeve including said bore.

21. The degradation assembly of claim 20, wherein said shaft comprises a shank, said shank being attached to said base end by a locking mechanism, and said shank being rotatably receivable within said bore of said sleeve.

22. A degradation assembly for use with a driving mechanism, said degradation assembly comprising:

a carbide bolster having a base end and a working end;

a wear resistant tip bonded to said working end;

a shaft having a first end and a second end spaced from said first end, said first end being attached to said base end;

a support portion connectable to a driving mechanism, said support portion having a bore formed therein, said bore being sized and shaped to receive said shaft and to support said shaft in rotatable connection with said support portion;

an O-ring groove, said O-ring groove being formed within one of an outside surface of said shaft and an inside surface of said bore; and an O-ring, said O-ring being located within said O-ring groove, said O-ring being adapted to contact the other of said outside surface of said shaft and said inside surface of said bore, and said O-ring being at least 15 percent compressed to impede rotation of said shaft and said bore relative to each other.

23. The degradation assembly of claim 22, wherein said resistance means comprises:

an O-ring groove, said O-ring groove being formed into an inside surface of said bore; and an O-ring, said O-ring positionable within said O-ring groove, said O-ring being adapted to contact an outside surface of said shaft.

24. The degradation assembly of claim 22, further comprising a tapered receptacle formed in said first end of said shaft, said tapered receptacle being adapted to receive therein a tapered base end of said carbide bolster.

25. The degradation assembly of claim 22, wherein said shaft comprises:

a shank, said shank being attached to said base end; and a sleeve, said sleeve being disposed about said shank.

26. The degradation assembly of claim 25, further comprising a locking mechanism, said locking mechanism being configured to attach said shank to said base end.

27. The degradation assembly of claim 26, wherein said locking mechanism is axially disposed within each of said shank and said bore.

28. The degradation assembly of claim 25, wherein said resistance means is adapted to contact an outside surface of said sleeve.

29. The degradation assembly of claim 22, wherein said support portion comprises:

a fixed portion, said fixed portion connectable to said driving mechanism; and a sleeve, said sleeve installed within said fixed portion, said sleeve including said bore.

30. The degradation assembly of claim 29, wherein said shaft comprises a shank, said shank being attached to said base end by a locking mechanism, and said shank being rotatably receivable within said bore of said sleeve.

* * * * *

UNITED STATES PATENT AND TRADEMARK OFFICE

CERTIFICATE OF CORRECTION

PATENT NO. : 8,007,050 B2
APPLICATION NO. : 12/051586
DATED : August 30, 2011
INVENTOR(S) : David R. Hall, Ronald Crockett and Jeff Jepson It is certified that error appears in the above-identified patent and that said Letters Patent is hereby corrected as shown below:

On the Title Page:

Item [60]

"11/965,672, filed on Dec. 27, 2007, which is a"

should be replaced with the following line:

"11/695,672, filed on April 3, 2007, which is a".

Signed and Sealed this
Thirteenth Day of December, 2011

David J. Kappos

David J. Kappos
*Director of the United States Patent and Trademark Office*